US012752172B2

(12) United States Patent
Escobar Serrano

(10) Patent No.: US 12,752,172 B2
(45) Date of Patent: Oct. 6, 2026

(54) SWING PATH TRAINING APPARATUS

(71) Applicant: Cesar Eduardo Escobar Serrano, Auburn Hills, MI (US)

(72) Inventor: Cesar Eduardo Escobar Serrano, Auburn Hills, MI (US)

(73) Assignee: Cesar Eduardo Escobar Serrano, Auburn Hills, MI (US)

( * ) Notice: Subject to any disclaimer, the term of this patent is extended or adjusted under 35 U.S.C. 154(b) by 887 days.

(21) Appl. No.: 18/009,573

(22) PCT Filed: Jun. 9, 2021

(86) PCT No.: PCT/US2021/036635
§ 371 (c)(1),
(2) Date: Dec. 9, 2022

(87) PCT Pub. No.: WO2021/252641
PCT Pub. Date: Dec. 16, 2021

(65) Prior Publication Data

US 2023/0241475 A1 Aug. 3, 2023

Related U.S. Application Data

(60) Provisional application No. 63/036,701, filed on Jun. 9, 2020.

(51) Int. Cl.
*A63B 69/38* (2006.01)

(52) U.S. Cl.
CPC ..... *A63B 69/38* (2013.01); *A63B 2214/00* (2020.08); *A63B 2225/093* (2013.01)

(58) Field of Classification Search
CPC ..... A63B 69/38; A63B 69/3621; A63B 69/36211; A63B 2214/00; A63B 2225/093
See application file for complete search history.

(56) References Cited

U.S. PATENT DOCUMENTS 3,231,271 A * 1/1966 Murphy ..... A63B 69/38 473/461
3,339,927 A * 9/1967 Nunn ..... A63B 69/36211 473/258

(Continued)

FOREIGN PATENT DOCUMENTS

CN 114870381 A * 8/2022 ..... A63B 69/38
GB 479561 4/1916

(Continued)

OTHER PUBLICATIONS

International Preliminary Report on Patentability for International Patent Application No. PCT/US2021/036635 dated Dec. 22, 2022.

(Continued)

*Primary Examiner* — Raleigh W Chiu
(74) *Attorney, Agent, or Firm* — Carlson, Gaskey & Olds, P.C.

(57) ABSTRACT

A swing path training apparatus includes a support structure and a path member supported on the support structure. The path member includes an inner guide and an outer guide defining a path therebetween. The path tracks the geometry of a swing path. The path member also includes a closed end connecting the inner guide and the outer guide and an opening configured to allow a racquet to be inserted into or removed from the path. A method of training a swing path apparatus is also disclosed.

16 Claims, 16 Drawing Sheets

(56) References Cited

U.S. PATENT DOCUMENTS

| | | | | |
|---|---|---|---|---|
| 4,105,204 | A * | 8/1978 | Koenig | A63B 69/38 473/461 |
| 5,441,255 | A * | 8/1995 | Verbick | A63B 23/03508 482/130 |
| 5,895,327 | A * | 4/1999 | Francisco | A63B 69/36211 473/409 |
| 6,645,094 | B2 * | 11/2003 | Obidiegwu | A63B 69/38 473/461 |
| 7,056,224 | B1 * | 6/2006 | Keyes | A63B 69/3621 473/229 |
| 7,074,133 | B1 * | 7/2006 | Jones | A63B 69/3621 473/226 |
| 8,715,098 | B2 * | 5/2014 | Napolitano | A63B 69/36211 473/258 |
| 9,227,130 | B1 * | 1/2016 | Burdick | A63B 69/385 |
| 9,814,928 | B2 * | 11/2017 | Taylor | A63B 21/0058 |
| 9,889,360 | B1 * | 2/2018 | Wilson | A63B 69/0002 |
| 10,471,327 | B1 * | 11/2019 | Imahata | A63B 69/0002 |
| 2005/0113193 | A1 | 5/2005 | Wardle et al. | |
| 2010/0048315 | A1 | 2/2010 | Turner | |
| 2011/0092303 | A1 | 4/2011 | Willis | |
| 2017/0144048 | A1 * | 5/2017 | Loucareas | A63B 69/0057 |

FOREIGN PATENT DOCUMENTS

| | | | | |
|---|---|---|---|---|
| KR | 20240084916 | A * | 6/2024 | A63B 43/00 |
| WO | WO-2021252641 | A1 * | 12/2021 | A63B 69/0057 |

OTHER PUBLICATIONS

International Search Report and Written Opinion for International Patent Application No. PCT/US2021/036635 dated Sep. 23, 2021.

* cited by examiner

L
W
T
106
106a
106b
104
104a
104b
114
116
118
120
121
122
124

SWING PATH TRAINING APPARATUS

RELATED APPLICATIONS

This application claims priority to U.S. Provisional Application No. 63/036,701 filed Jun. 9, 2020.

BACKGROUND

This disclosure relates to athletic training devices, specifically a swing path training apparatus. Swing paths are used in various sports such as racquet sports, golf, baseball, and others.

Racquet sports, such as tennis, for example, can incorporate the use of several different racquet swing paths. For instance, in tennis the forehand stroke, backhand stroke, and volleys are used to return a ball hit by an opposing player after a serve or during a point. Learning the proper swing path for a particular stroke or other swing for various sports may be achieved by proper repetition of a chosen technique. Many times, such technique and repetition comes in response to verbal or visual instruction given to a player so that the player can learn various swing paths and strokes. However, verbal instruction from instructors and coaches, or visual instruction, e.g., by in-person demonstration or video demonstration, is not always available and may differ from one instructor to the next. Further, players may perceive instructions differently which could result in incorrect application of the instructions. Moreover, users could benefit from the ability to repeat proper swing paths and techniques during times when the instructor may not be available to give verbal instruction, for example when taking a lesson with more than one student or when the student is practicing on their own.

SUMMARY

Figure 1A:
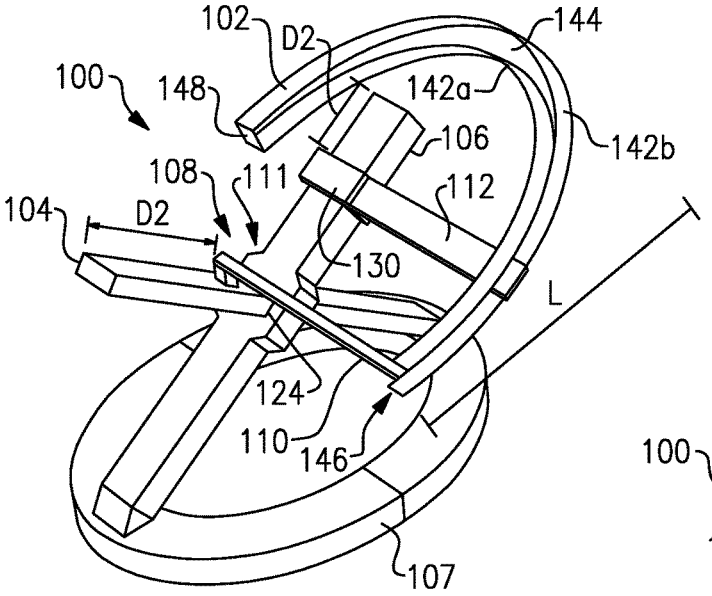
FIG. 1A shows an example swing path training apparatus in an extended position.

A swing path training apparatus according to an exemplary embodiment of this disclosure, among other possible things includes a support structure and a path member supported on the support structure. The path member includes a first guide and a second guide defining a path therebetween. The path tracks the geometry of a swing path. The path member also includes a closed end connecting the first guide and the second guide and an opening configured to allow a racquet to be inserted into or removed from the path.

In a further example of the foregoing, the path member is supported on the support structure via one or more retractable rods.

In a further example of any of the foregoing, the path is a curved path.

In a further example of any of the foregoing, the path is an angled path.

In a further example of any of the foregoing, the path member comprises a plurality of segments removably connected to one another.

In a further example of any of the foregoing, the plurality of segments are connected to one another via a corrugated track and a corrugated tab configured to be received in the corrugated track.

In a further example of any of the foregoing, wherein the angled path includes a first portion, a second portion perpendicular to the first portion, and a third portion perpendicular to the first and second portions.

In a further example of any of the foregoing, the support structure includes a first support and a second support, and the first and second supports cross one another at a connection point.

In a further example of any of the foregoing, the first support includes an opening configured at the connection to receive the second support.

In a further example of any of the foregoing, the support structure includes a support having a first end and a second end. The first end is connected to the path member, and the second end has a clamp. The clamp is configured to be connected to a post.

In a further example of any of the foregoing, the support is a first support and the clamp is a first clamp. The swing path training apparatus also includes a second support, the second support having a second clamp configured to be connected to the post.

In a further example of any of the foregoing, the path is a curved path.

In a further example of any of the foregoing, the path is an angled path.

In a further example of any of the foregoing, the swing path training apparatus includes a spin guide adjacent the opening. The spin guide has a wedge shape configured to affect an orientation of the racquet.

A method of training a swing path according to an exemplary embodiment of this disclosure, among other possible things includes inserting a racquet into a path of a path member via an opening, the path being defined between an first guide and a second guide. The path tracks the geometry of a swing path of the racquet. The method also includes positioning the racquet near a closed end of the path member and swinging the racquet along the path towards the opening.

In a further example of the foregoing, the method also includes removing the racquet from the path member via the opening.

In a further example of any of the foregoing, the path is a curved path.

In a further example of any of the foregoing, the path is an angled path.

In a further example of any of the foregoing, the method also includes moving the racquet past a spin guide arranged adjacent the opening after the swinging step, the spin guide having a wedge shape configured to affect an orientation of the racquet.

In a further example of any of the foregoing, the racquet is a tennis racquet. The method also includes positioning a throat of the tennis racquet in the path near the closed end of the path member.

DETAILED DESCRIPTION

The disclosed exemplary swing path training apparatus allows racquet players to develop and repeat proper technique for a variety of different types of swings that may be used during racquet sports. Though the swing path training apparatus is described with respect to racquet sports, it should be understood that it could be used to train swing paths in other sports such as baseball, golf, and others.

Figure 1B:
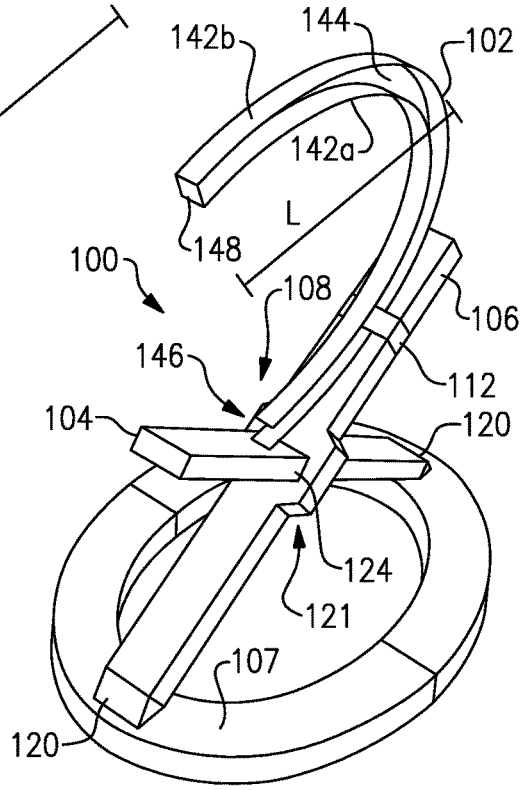
FIG. 1B shows the example swing path training apparatus of FIG. 1A in a retracted position.

An example embodiment of a swing path training apparatus 100 is shown in in FIGS. 1A-B. The example swing path training apparatus 100 includes a path member 102 and a support structure including one or more supports 104/106 for the path member 102. The path member is configured to receive a racquet and has a geometry that tracks the geometry of a swing for the racquet, as will be discussed in more detail below. The supports 104/106 are supported on a base 107. The path member 102 is connected to the supports 104/106 via rods 110/112. In this example, one rod 110/112 corresponds to each support 104/106, though in other examples more rods could be used. The rods 110/112 are configured to extend and retract. FIG. 1A shows the rods 110/112 in an extended position, and FIG. 1B shows the rods 110/112 in a retracted position. For example, the rods 110/112 may include a telescoping or other retraction feature as would be known in the art.

In one example, the swing path training apparatus 100 comprises a durable, smooth and lightweight material to allow for the swing path training apparatus 100 to be easily transported across a range of environments by an individual. An exemplary material includes lightweight aluminum that is polished to allow for a racquet to travel smoothly and unharmed around the path member 102. Additionally, a protective coating such as a plastic, paint, or rubber may be applied to the path member 102 to further prevent damage to the user's racquet. The supports 104/106 and/or rods 110/112 can comprise a stronger and more rigid material than the path member 102 and/or base 107, such as steel, to stabilize the apparatus 100. However, other materials other than those described above may also be used.

Figures 2A, 2B, 2C, 2D:
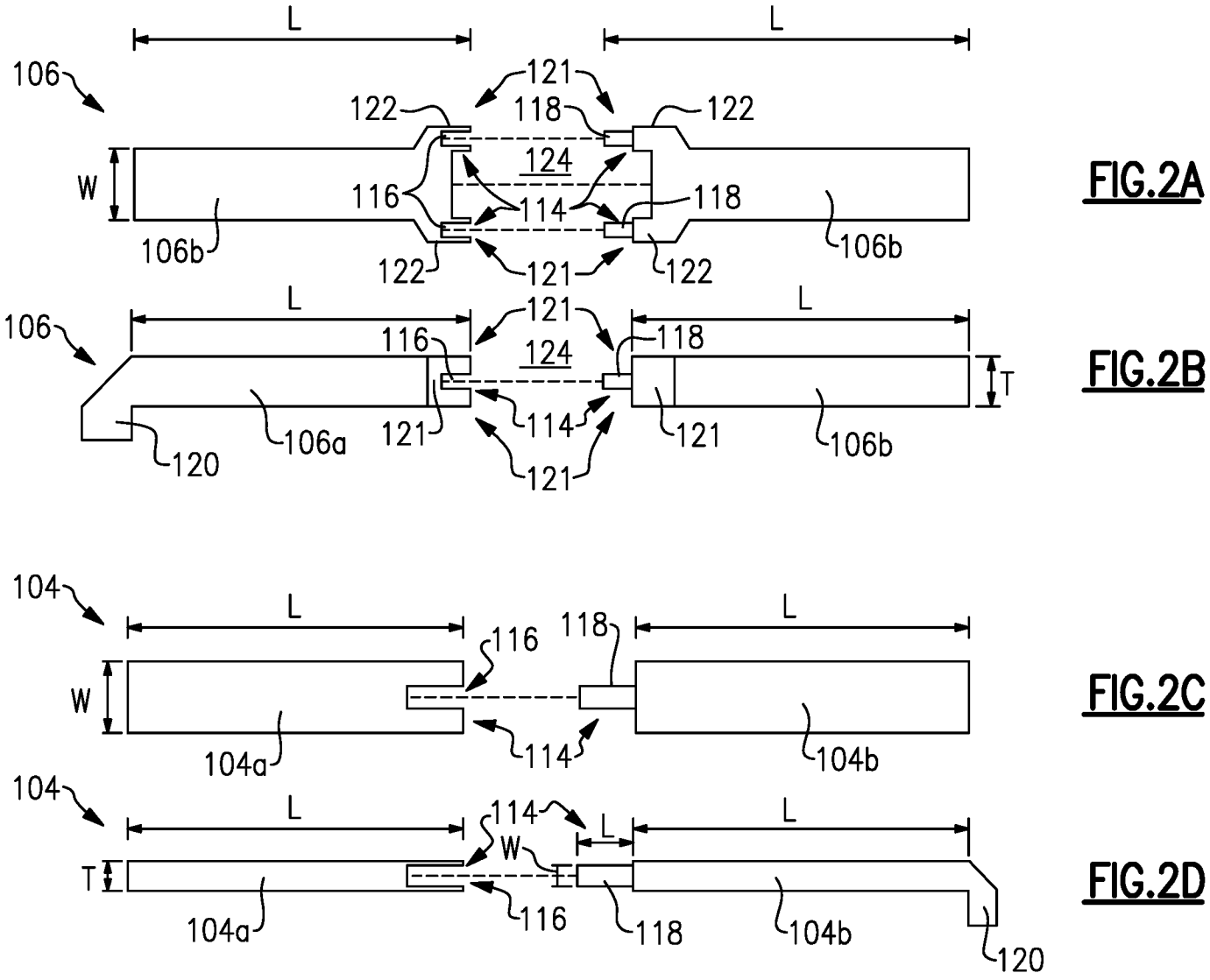
FIG. 2A shows a top-down view of a first support of the swing path training apparatus of FIGS. 1A-B.
FIG. 2B shows a side view of the first support of FIG. 2A.
FIG. 2C shows a top-down view of a second support of the example swing path training apparatus of FIGS. 1A-B.
FIG. 2D shows a side view of the second support of FIG. 2C.

In the example of FIGS. 1A-B, there are two supports 104/106 that extend in opposing directions and cross one another at a connection point 108. FIGS. 2A-B show a detail view of the support 106 and FIGS. 2C-D show a detail view of the support 104. Referring to FIGS. 2C-D, the support 104 includes first and second portions 104*a*/104*b*. The portions 104*a*/104*b* are configured to connect to one another via a lock 114. The lock 114 could be a reversible attachment, e.g., the portions 104*a*/104*b* could be disassembled from one another. In this example, the lock 114 includes a tongue-and-groove type attachment. More particularly, the portion 104*a* includes a groove 116 configured to receive a tongue 118 on the second portion 104*b*. In other examples, the portion 104*b* could include the groove 116 and the portion 104*a* could include the tongue 118. Further, other locks 114 are contemplated. The support 104 also includes a base attachment 120 on one of the first and second portions 104*a*/104*b* which is configured to attach to the base 107 as will be discussed in more detail below. In one example, each of the portions 104*a*/104*b* have a length L between 12 and 16 inches. In this example, the total length of the support 104 is between about 24 and 32 inches. In one example, each of the portions 104*a*/104*b* have a width W of about 2-10 inches and a thickness T of about 1-5 inches.

Referring now to FIGS. 2A-B, the cross support 106 is shown. The cross support 106 also has first and second portions 106*a*/106*b*. The portions 106*a*/106*b* can have similar dimensions to the portions 104*a*/104*b* of the support 104 described above. The support 106 also includes a base attachment 120 on one of the first and second portions 106*a*/106*b* which is configured to attach to the base 107 as will be discussed in more detail below. Each of the first and second portions includes an enlarged end 121 with spaced-apart prongs 122. The prongs 122 define an opening 124. The opening 124 is configured to receive the support 104 to form the connection point 108 (as best shown in FIGS. 1A-B). In this example, each of the prongs 122 has a lock 114 such as the groove/tongue 116/118 features described above, though as above other locks 114 could also be used.

As shown in FIG. 2D, any of the exemplary tongues 116 described herein can have a width W of about 1-2 inches and a length L of about 2-4 inches. Any of the exemplary grooves 118 described herein can have dimensions configured to receive the tongues 116.

Figure 3A:
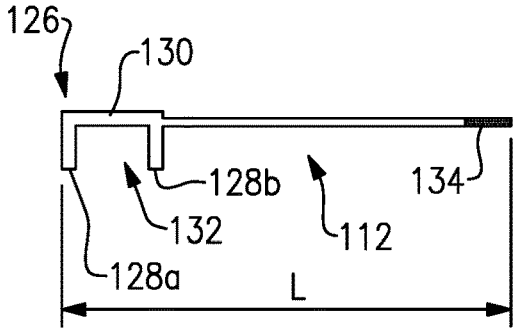
FIG. 3A shows a side view of a first rod for the swing path training apparatus of FIGS. 1A-B.
Figure 3B:
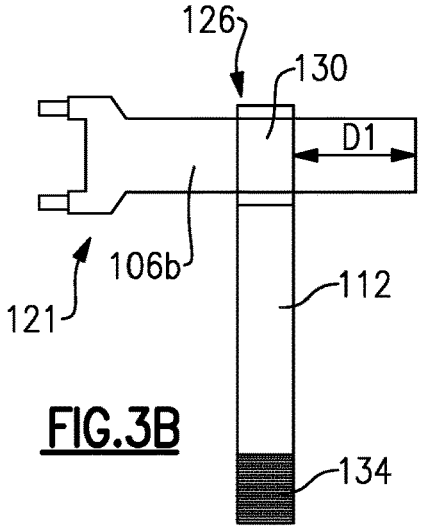
FIG. 3B shows the rod of FIG. 3A engaged with the support of FIGS. 2C-D.

Turning now to the rods 110/112, FIGS. 3A-D show detail views of the rods 110/112 and the rods 110/112 engaged with the respective supports 104/106. FIG. 3A shows the rod 112. FIG. 3B shows the rod 112 engaged with the support 106. The rod 112 includes a claw member 126. The claw member 126 includes two legs 128*a*/128*b* that extend from a top portion 130. The legs define an opening 132. The opening 132 is configured to receive the support 106 therein, as shown in FIG. 3B. Specifically the claw 126 receives the portion 106*b* of the support that does not include the base attachment 120. In one example, the claw member 126 is slidable along the support 106. The claw member 126 may include a lock feature (not shown) such as the tongue/groove lock discussed above to lock the claw member 126 and rod 112 in place with respect to the support 106. Opposite the claw member 126 the rod 112 has a connector 134 for connecting the rod 112 with the path member 102. As shown in FIG. 3B, the claw 126 can be situated a distance D1 from an end of the support 106.

Figure 3C:
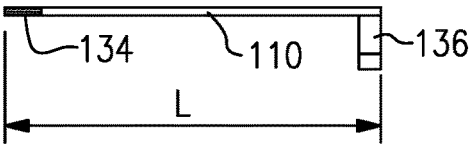
FIG. 3C shows a side view of a second rod for the swing path training apparatus of FIGS. 1A-B.
Figure 3D:
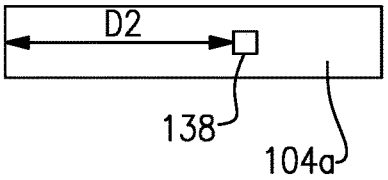
FIG. 3D shows a detail view of the rod of FIGS. 2A-B including an opening for engaging with the rod of FIG. 3C.

FIG. 3C shows the rod 110 and FIG. 3D shows the rod 110 engaged with the support 104. The rod 110 includes a connector protrusion 136 which is configured to be received in an opening 138 in the support 104. Specifically the opening 138 is in the portion 104*a* of the support that does not include the base attachment 120. As shown in FIG. 3D, the protrusion 136/opening 138 can be situated a distance D2 from an end of the support 104. In some examples, D2 is greater than D1, that is, the opening 138 is relatively closer to the connection point 108 than the claw member 126 (see FIG. 1A). Opposite the protrusion 136 the rod 110 has a connector 134 for connecting with the path member 102.

In some examples, one or both rods 110/112 have an extended position, as shown in FIG. 1A, and a retracted position, as shown in FIG. 1B. The rods 110/112 include a retracting feature, such as a telescoping feature as would be known in the art, for moving between the retracted and extended positions. In the extended position, the path member 102 provides an unobstructed swing path for a user (which will be discussed in more detail below). The retracted position could be used for storing the apparatus 100, for instance.

Figure 1C:
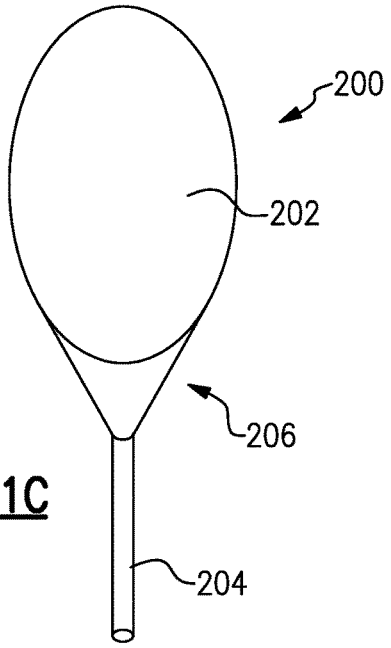
FIG. 1C shows an example racquet for use with the swing path training apparatus described herein.

An example racquet 200 is shown in FIG. 1C. As shown, the racquet 200 includes a handle 204, strings 202 disposed in the head of the racquet 200, and a throat 206. The throat 206 is a "V"-shaped portion between the handle 204 and the strings 202 in the head of the racquet 200. Referring back to FIGS. 1A-B, the path member 102 includes inner and outer guides 142*a*/142*b* which define a gap 144 therebetween. In this example, the gap 144 corresponds to a curved path. The path member 102 has an open end 146 and a closed end 148 (e.g., at the closed end 148, the guides 142*a*/142*b* are connected to one another). The gap 144 is configured to receive the throat 206 of the tennis racquet 200. The guides 142*a*/142*b* have a geometry that corresponds to a swing path that a user would follow for swinging the racquet 200. Thus, the guides 142*a*/142*b* are configured to guide the racquet 200 through a desired stroke. The closed end 148 corresponds to the beginning of the swing path and the swing proceeds towards the open end 146, which allows the racquet 200 to be removed from the apparatus 100. In some examples, the path member 102 has a length L of about 3 feet.

In the example of FIGS. 1A-B, the inner guide 142*a* is connected to the rod 110 and the outer guide 142*b* is connected to the rod 112, though other arrangements are contemplated so long as the path member 102 is supported by the rods 110/112.

In one example, the inner guide 142*a* and outer guide 142*b* are integral with one another, e.g., the path member 102 is a single unitary structure, but in other examples, the path member 102 includes multiple assembled structures.

Figure 4:
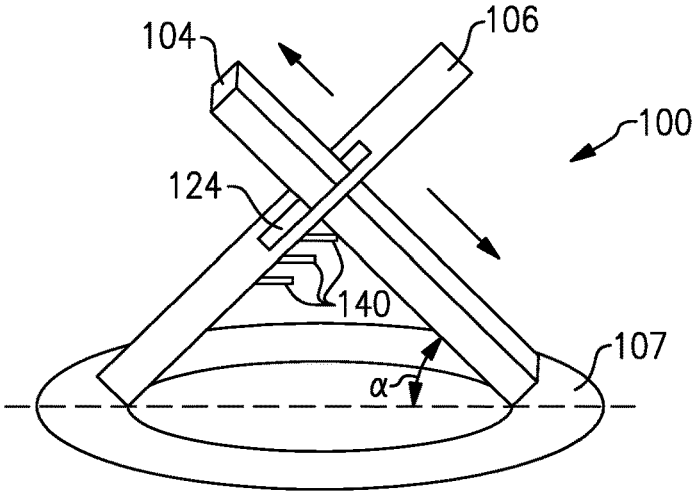
FIG. 4 shows another embodiment of the swing path training apparatus of FIGS. 1A-B.

Referring now to FIG. 4, in one example, the support 106 includes an elongated opening 124 configured to receive the support 104, and the support 106 includes one or more notches or holders 140 configured to engage the support 104. Support 104 can be moved within the opening 124 to vary which notch/holder 140 it is supported on, which in turn varies an angle $\alpha$ which is defined between the support 104 and the ground. In one example, the angle $\alpha$ can be between about 45 and 160 degrees. Because the path member 102 is supported on the support 104, in general, the greater the angle $\alpha$, the higher from the ground the path member 102 is. The notches/holders 140 therefore allows for the path member 102 to be adjustable in height relative to the ground, for example, so that the apparatus 100 can be used by users of various heights.

Figure 5A:
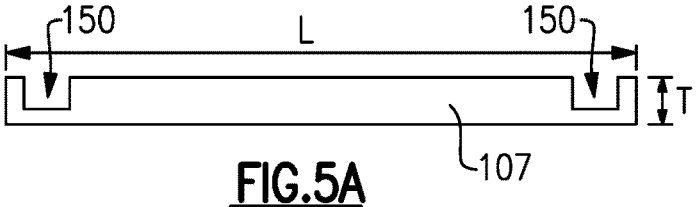
FIG. 5A shows a side view of a base for the swing path training apparatus of FIGS. 1A-B.
Figure 5B:
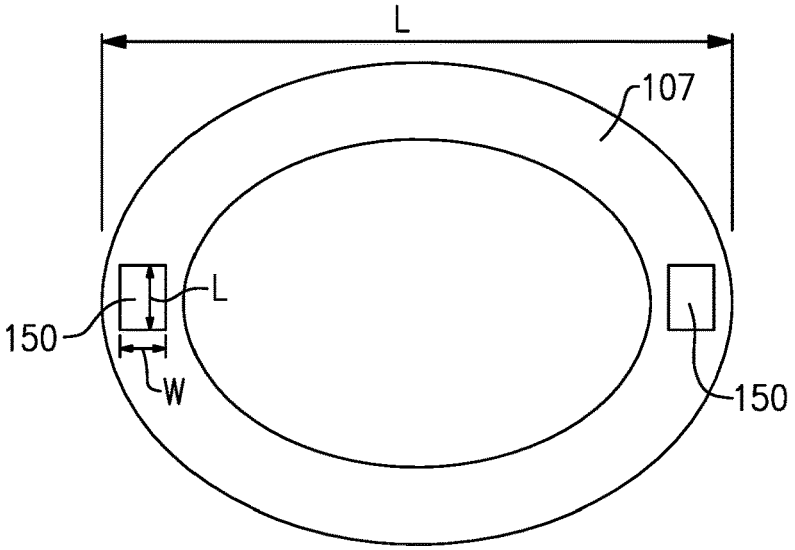
FIGS. 5B-C show top views of various embodiments of the base for the swing path training apparatus of FIGS. 1A-B.
Figure 5C:
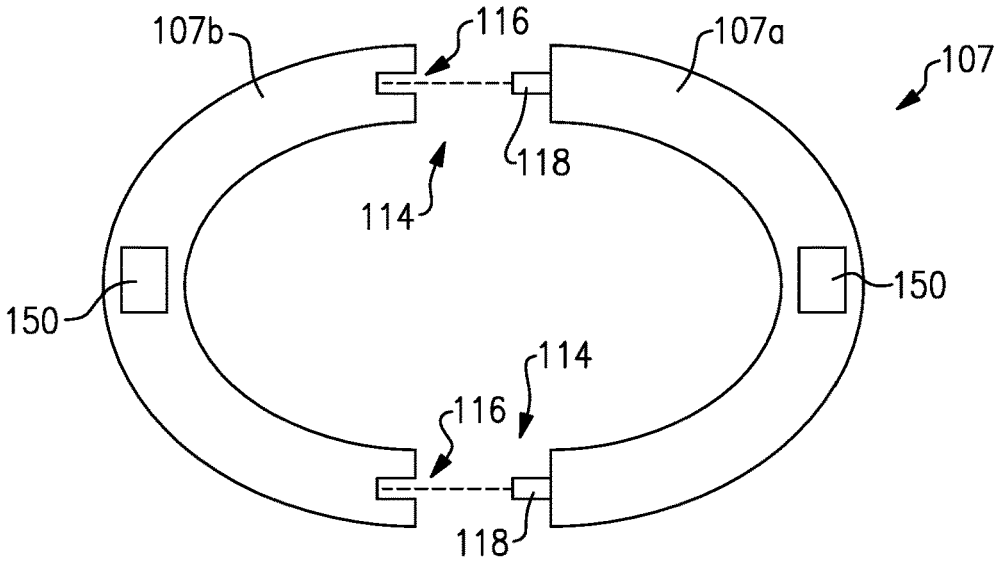

Referring now to FIG. 5A-C, the base 107 is shown. Though the base 107 in these examples is an oval shape, any other shape could be used. The base 107 includes ports 150, which are configured to receive the base attachments 120 of the supports 104/106 for connecting the supports 104/106 to the base 107. The supports 104/106 could be reversibly received in the ports 150, in some examples. The ports 150 are located at opposed ends of the longest dimension L of the base 107. In some examples, the longest dimension L could be about 4 feet and the thickness T of the base 107 could be between about 2-5 inches. The ports 150 could have a length L of between about 1-10 inches and a width W of about 2-7 inches. The base attachments 120 are dimensioned to be received in and secured in the ports 150.

The base could be a unitary structure, as in FIGS. 5A-B, or could be made up of multiple portions 107*a*/107*b* as shown in FIG. 5C. In the example of FIG. 5C, the base could include one or more locks 114 for connecting the portions 107*a*/107*b* to one another. In some examples, the lock 114 could be reversible, as discussed above. An example lock 114 is the groove/tongue lock 116/118 like the one discussed above.

Figure 6A:
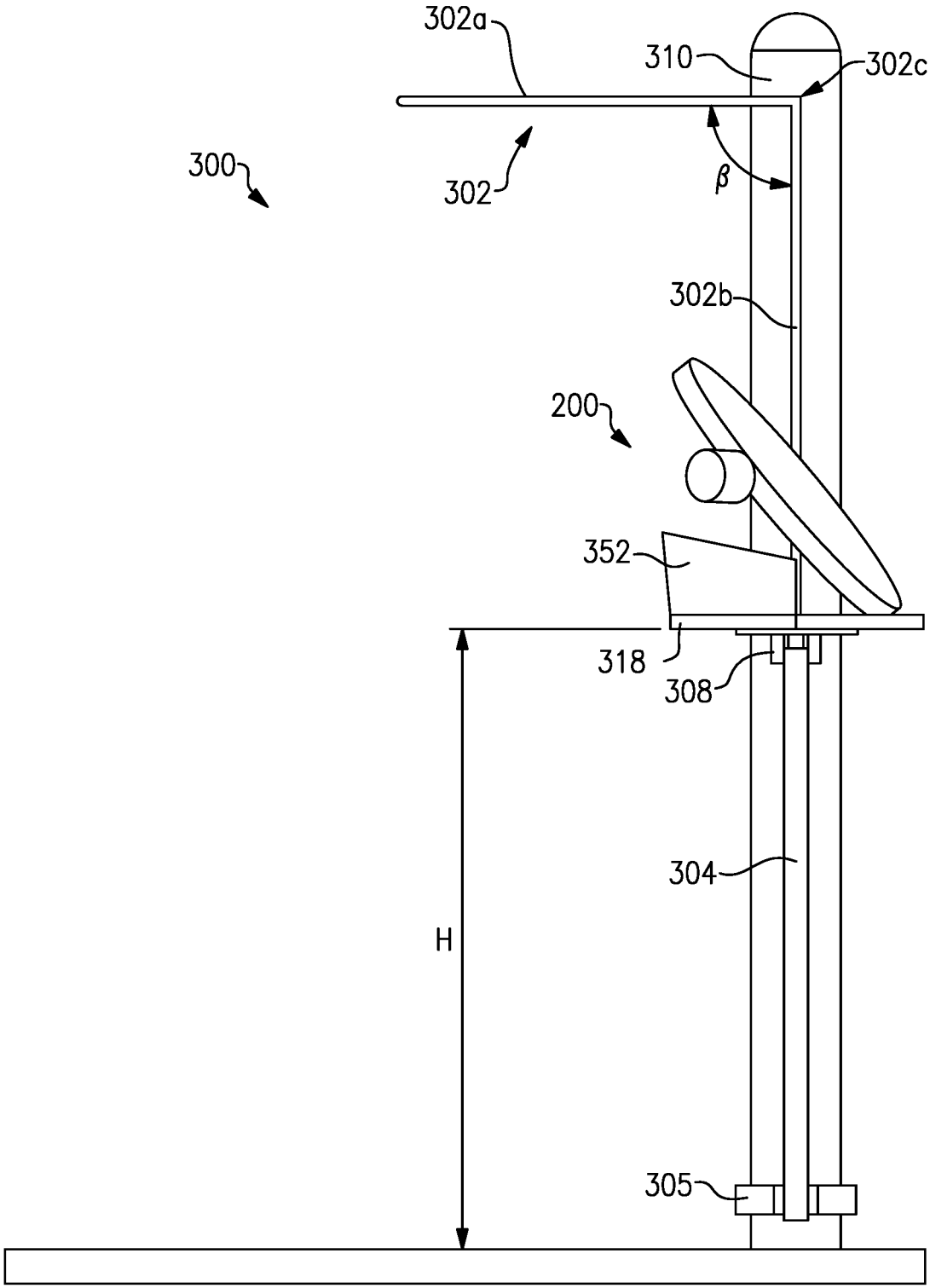
FIGS. 6A-C show another example swing path training apparatus.
Figure 6B:
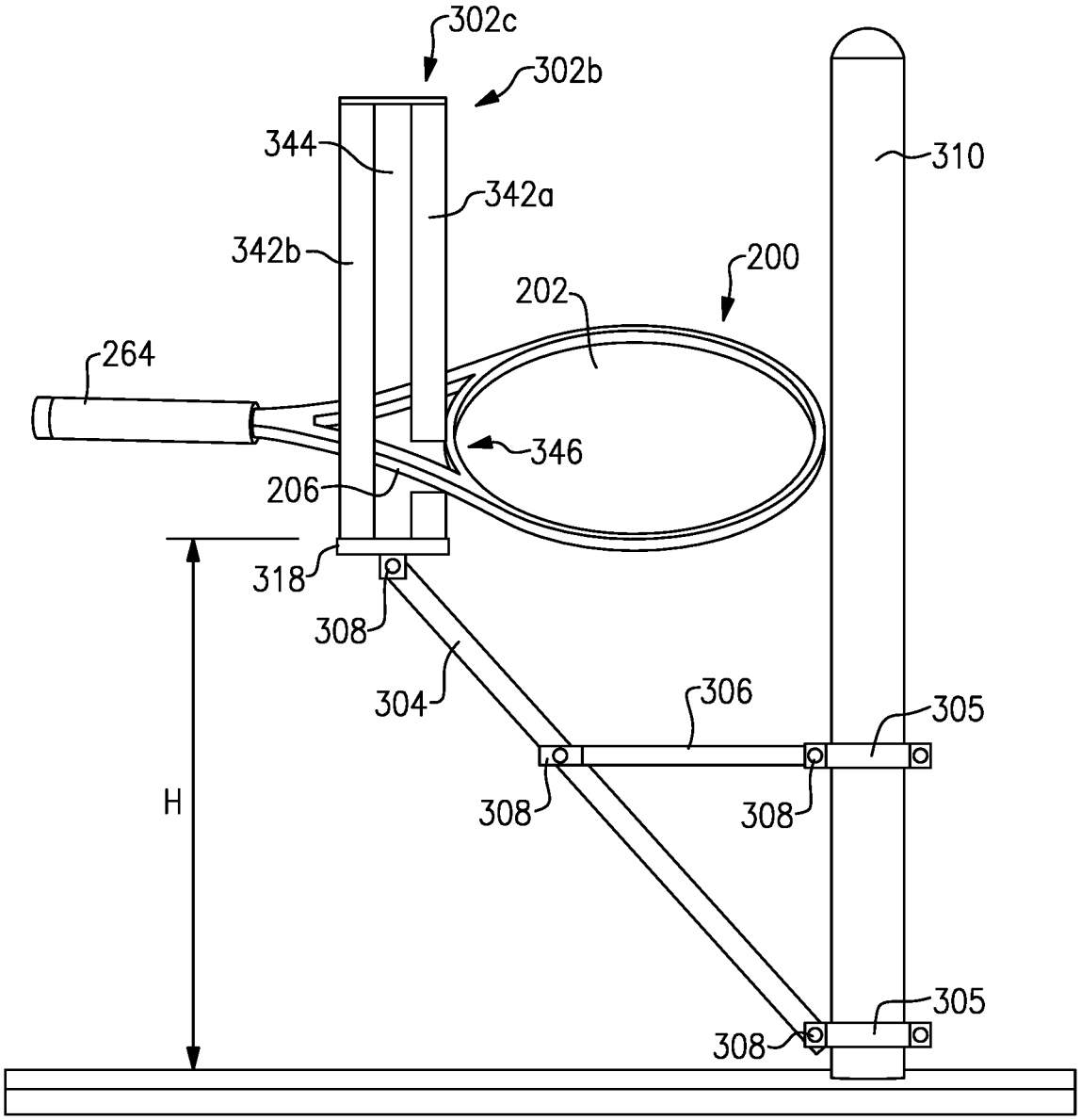
Figure 6C:
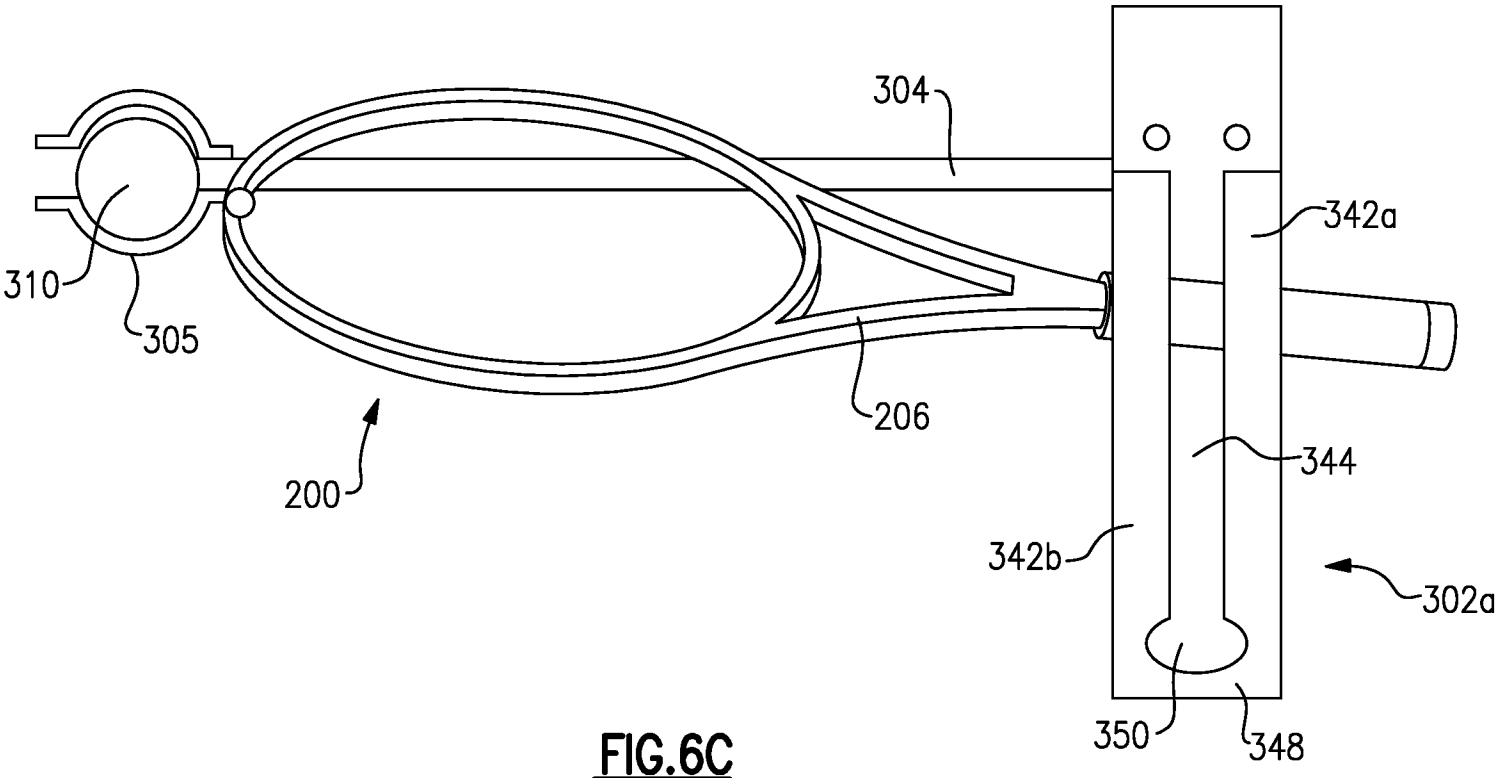

Another example swing path training apparatus 300 is shown in FIGS. 6A-C. The example apparatus 300 has a path member 302 and a support 304. Though the path member 302 is shown with the support 304, it should be understood that the path members 102/302 could be used interchangeably with either the supports 104/106 and base 107 discussed above, or with the support 304.

The support 304 is connected to the path member 302 at a first end and is connected to a clamp 305 at a second end opposite from the first end via connections 308. The connections 308 can be hinged/rotating connections. An optional second support 306 can be connected to and extend from the support 304. The support 306 is connected to the support 304 at a first end and to a clamp 305 at a second end opposite from the first end via connections 308. In the example of FIGS. 6A-B, the support 306 is generally perpendicular to the post 310 and parallel to the ground, though other arrangements are contemplated.

Figure 7:
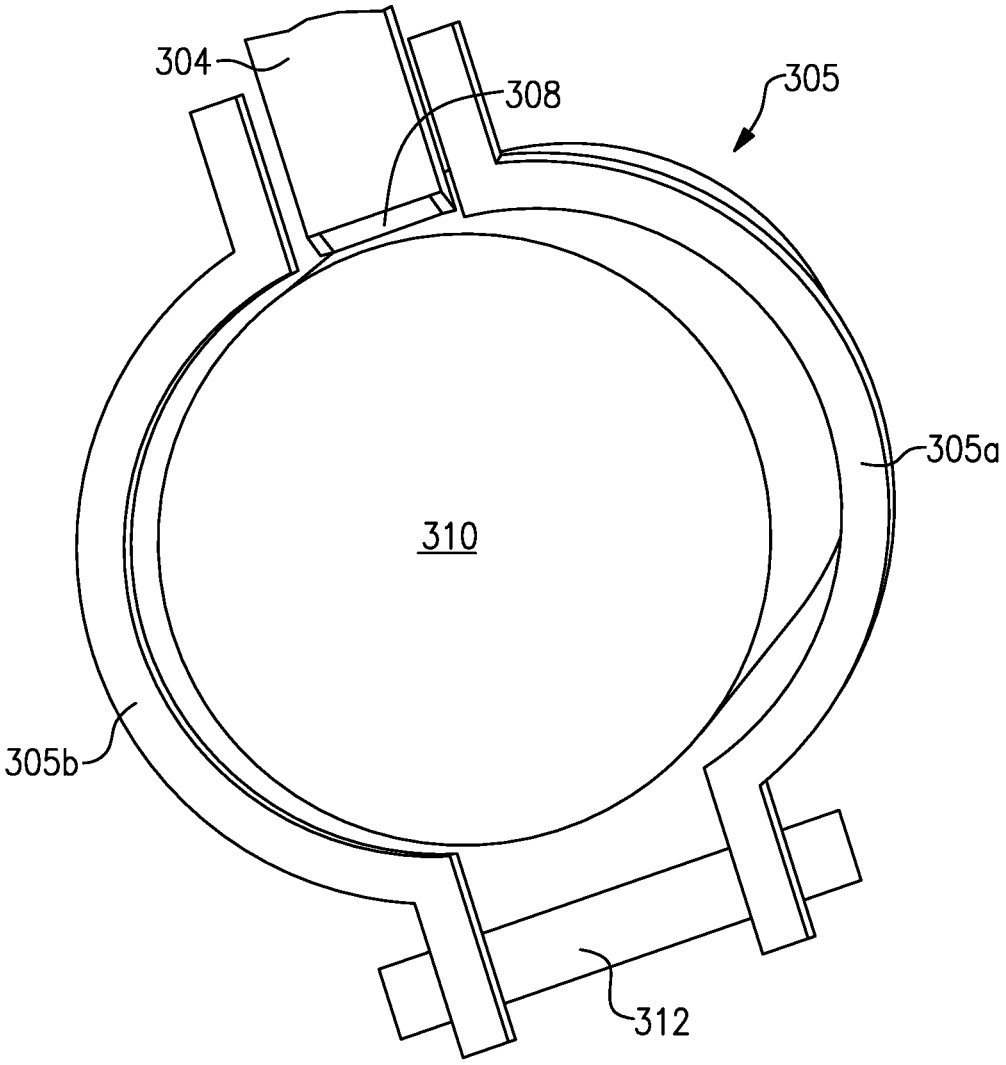
FIG. 7 shows a detail view of an example clamp for the swing path training apparatus of FIGS. 6A-C.

The clamps 305 are configured to be clamped to a post 310, such as a tennis net post. In one configuration, the support 304 is oriented so that it is in angled with respect to the post. FIG. 7 shows a detail view of the clamps 305. In this example, the clamps 305 include first and second curved portions 305*a*/305*b* configured to surround the post, and a fastener 312 configured to fix the curved portions 305*a*/305*b* to the post 310. In other examples, however, the clamps 305 could have other shapes. The clamps 305 could be installed and uninstalled from the post 310 by tightening or loosening the fastener 312. The clamps 305 are positioned on the post 310 to situate the path member 302 at a height H that is appropriate for a particular user, as discussed above.

Figure 8A:
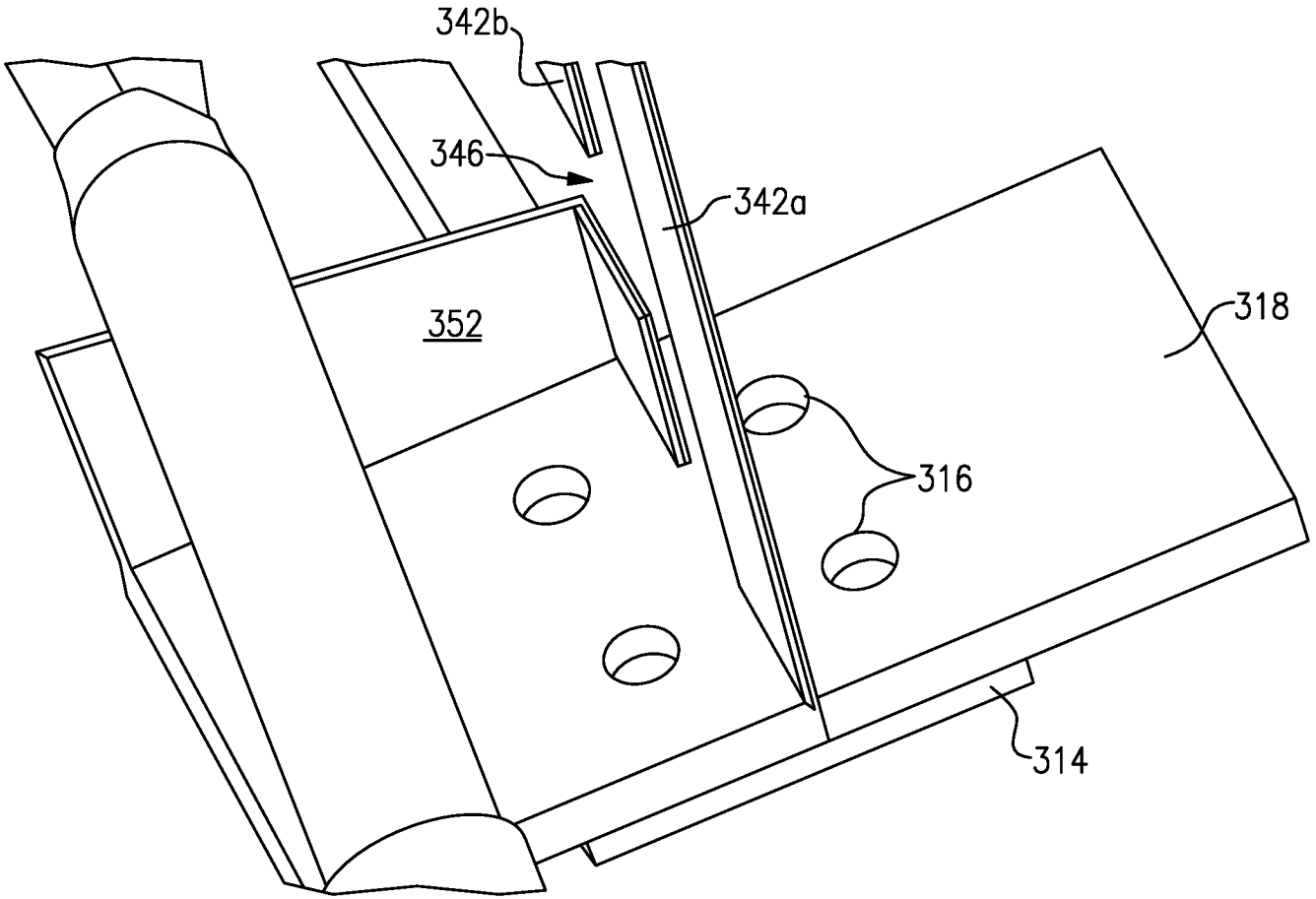
FIGS. 8A-B show detail views of an example connection between a support and a path member for the example swing path training apparatus of FIGS. 6A-C.
Figure 8B:
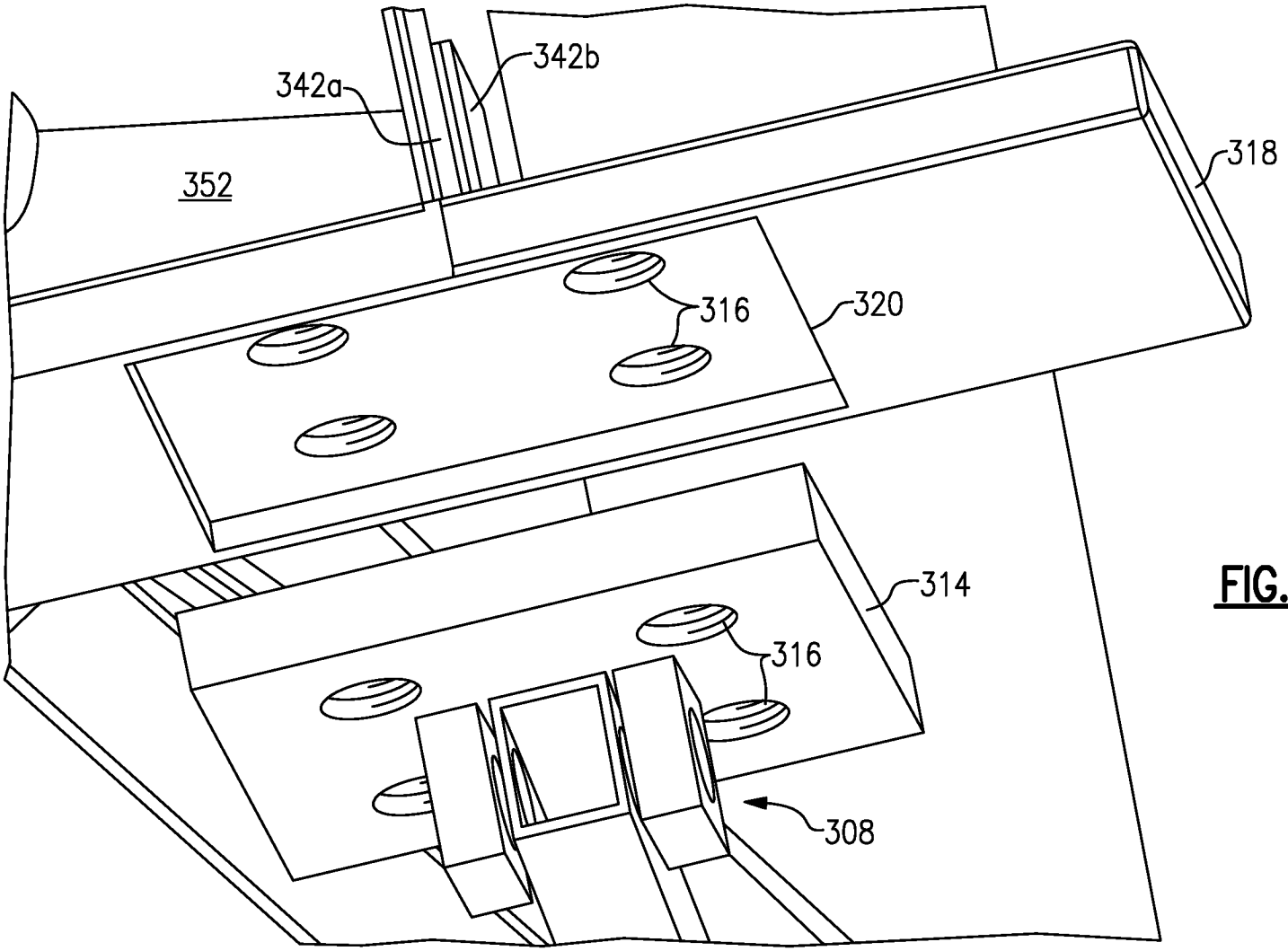
Figure 9:
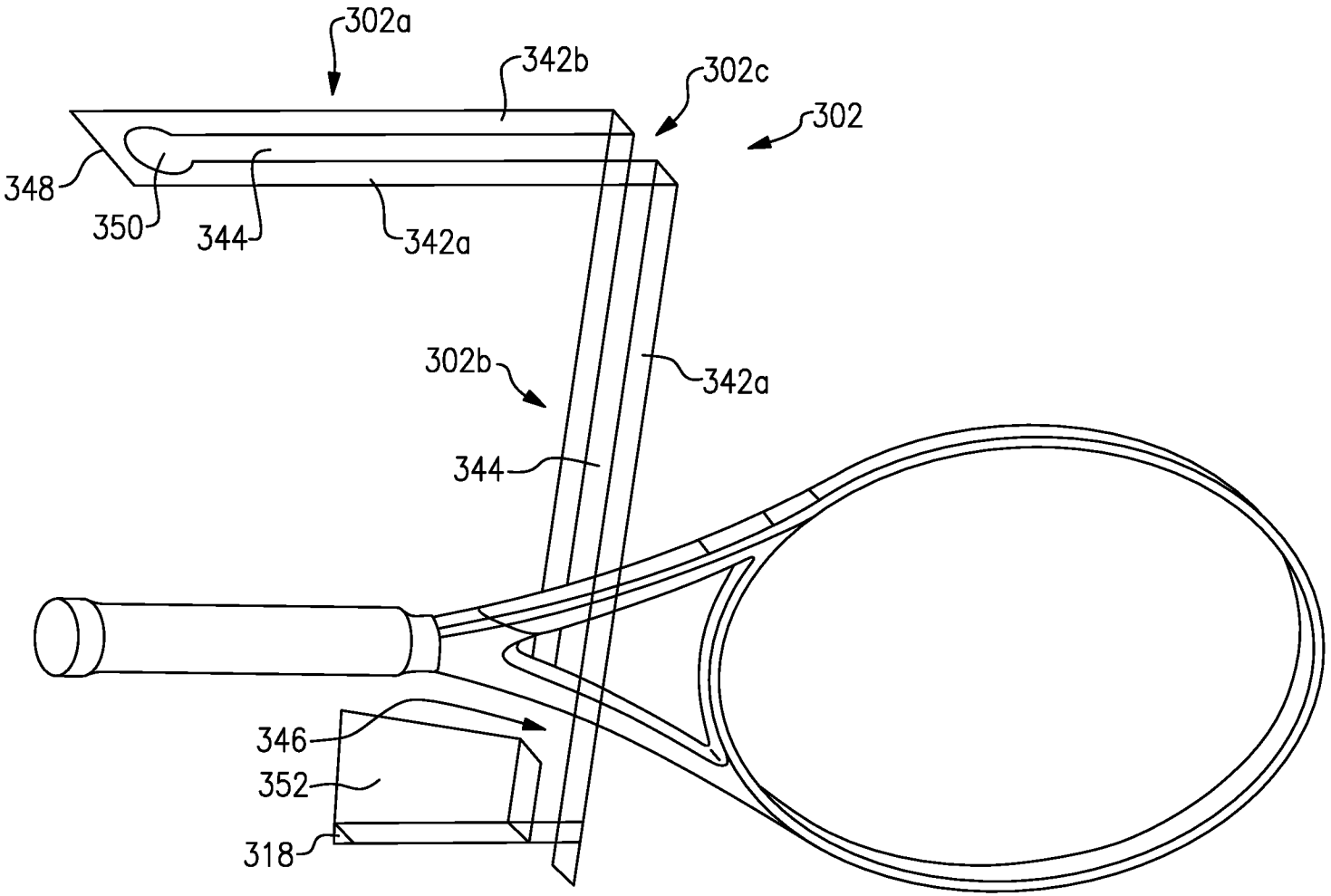
FIG. 9 shows a detail view of a path member for the swing path training apparatus of FIGS. 6A-B.

Referring to FIGS. 8A-B, a detail view of an example connection between support 304 and path member 302 is shown. In this example, the support 304 includes a connector plate 314 at the connection 308. The connector plate 314 includes one or more openings 316 that are configured to receive fasteners, such as screws (not shown). In one example, the screws could be size 3125-18. In this particular example, there are two openings 316 on either side of the connection 308 though in other examples, other arrangements could be used. The path member 302 also has a connector plate 318. The connector plate 318 has openings 316 which are located so that they correspond to the openings 316 on the connector plate 314. Therefore, fasteners can be inserted into each opening 316 to connect the connector plates 314/318 to one another. In one example, the connector plate 318 on the path member 302 includes a divot 320 that is configured to receive the connector plate 314 therein. The divot 320 can locate and/or stabilize the connector plate 314 with respect to the connector plate 318 to facilitate insertion of fasteners into the openings 316.

Referring now to FIGS. 6A-C and 9, the example path member 302 includes first and second portions 302*a*/302*b* joined at a transition point 302*c* to define an angled path. In the examples shown, the portions 302*a*/302*b* are generally perpendicular to one another, e.g., an angle β (FIG. 6A) between the portions 302*a*/302*b* is about 90 degrees, the first portion 302*a* is generally horizontal, and the second portion 302*b* is generally vertical with respect to the ground. In other examples, the angle β could be varied to provide different swing paths. Like the path member 102 described above, each of the portions 302*a*/302*b* includes guides 342*a*/342*b* that define a gap 344 therebetween. The gap 344 is continuous through the first and second portions 302*a*/302*b*. The gap 344 is configured to receive the racquet 200 throat 206. The guides 342*a*/342*b* and angle β provide a geometry that corresponds to a swing path that a user would follow for swinging the racquet 200. Thus the guides 342*a*/342*b* are configured to guide the racquet 200 through a desired stroke. The guides 342*a*/243*b* also allows the swing to proceed in such a way that the user has momentum when encountering a ball, which improves effectiveness of the stroke.

The first portion 302*a* extends between a closed end 348 (e.g., the guides 342*a*/342*b* of the first portion 302*a* are connected to one another at the closed end 348) and the transition point 302*c* opposite the closed end. The second portion 302*b* extends away from the transition point 302*c*. An opening or gap 344 is formed in one of the guide member 342*a*/342*b* near and end of the second portion 302*b* that is opposite from the transition point 302*c*. The closed end 348 corresponds to the beginning of the swing path and swing proceeds towards the opening 346, which allows the racquet 200 to be removed from the apparatus 300. In some examples, there is an enlarged portion 350 near the closed end 348 which allows for rotation/positioning of the racquet throat at the start of the swing.

An optional spin guide 352 is arranged near the opening 346. For example, the spin guide 352 could be situated on the plate 318 discussed above. In some examples, the spin guide 352 could be attached to the plate 318 via a removable attachment. The spin guide 352 has a wedge shape. The spin guide 352 has a geometry and position with respect to the opening 346 that encourages a racquet 200 in the gap 344 to angle upwards with respect to the ground as the racquet 200 exits the opening 346. The upward angle in turn encourages topspin to be created when hitting a ball, as will be discussed in more detail below.

Another example path member 402 is shown in FIGS. 10A-D. The path member 402 is similar to the path member 302 and can be used with swing path training apparatus 300. The path member 402 includes a third portion 402*d* extending from the first portion 302*a* and a second transition point 402*e*. The third portion includes the closed end 348. The third portion 402*d* is arranged so that it extends in a direction that is generally perpendicular to the second portion 302*b* and to the first portion 302*a*.

Figure 10A:
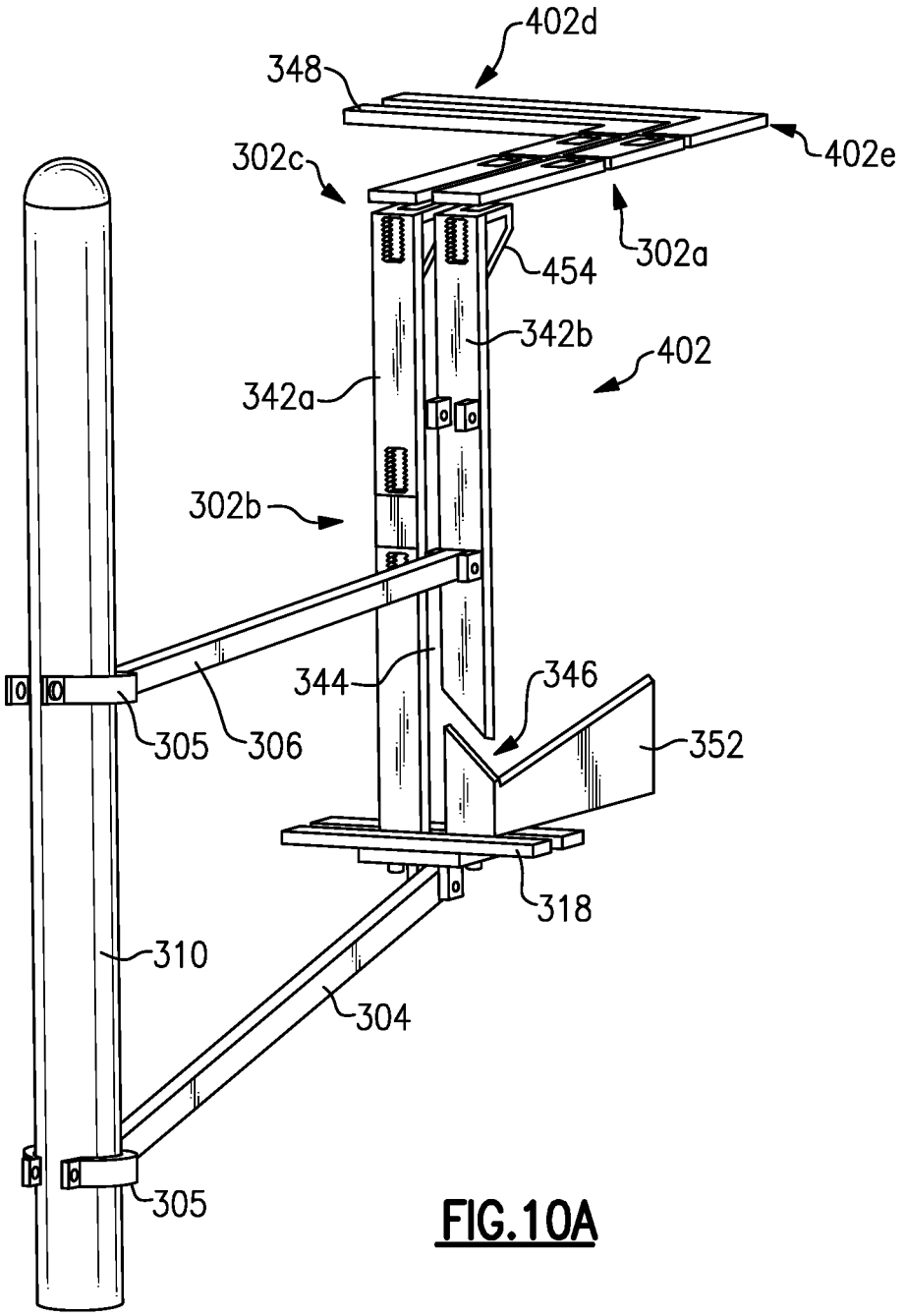
FIGS. 10A-D show a swing path training apparatus similar to that of FIGS. 6A-C but having an alternate example path member.
Figure 10B:
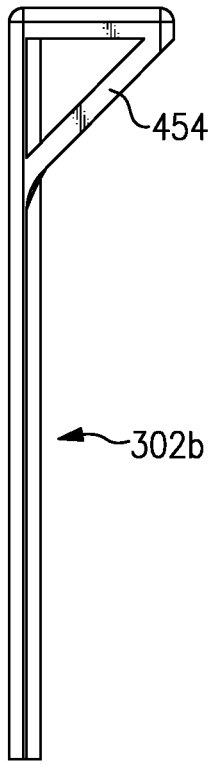

The path member 402 also includes an optional support brace 454 for supporting each of path members at the transition point 302*c*, shown in FIG. 10B. The support brace 454 can have a triangular shape that corresponds to the angle β (FIG. 6A) between the portions 302*a*/302*b*. Though the support braces 454 are shown with the example path member 402, it should be understood that the support braces 454 could also be used with the example path member 302.

Additionally, in the example of FIG. 10A, the optional second support member 306 is connected to the path member 402, and more particularly the guide member 342*b*. It should be understood that the optional second support member 306 could alternatively be connected to the guide member 342*a*. It should also be understood that either arrangement of the support member 306 could be employed for path member 302.

Figure 10C:
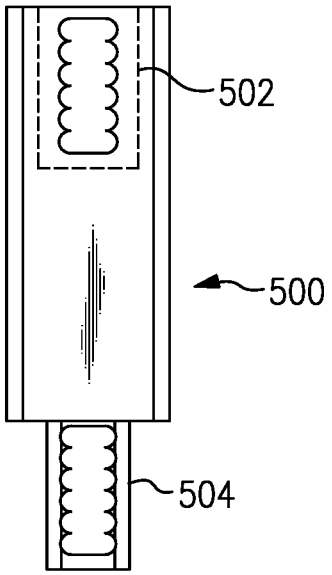
Figure 10D:
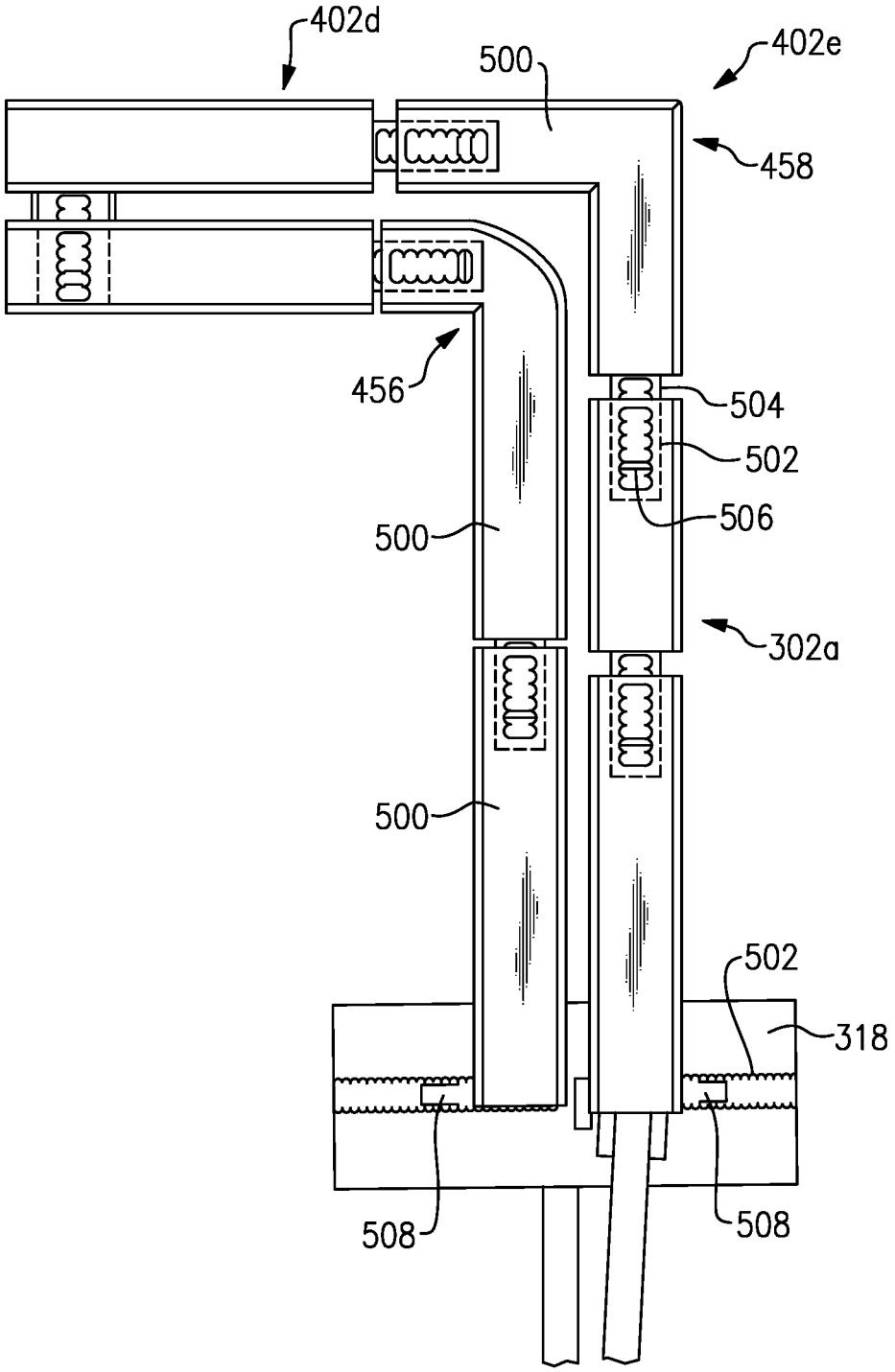

In some examples the path member 302/402 is a modular and adjustable path member 302/402 and comprises multiple segments 500. The multiple segments 500 can be reversibly connected to one another to form the path member 302/402. Therefore, the path member 302/402 can be disassembled for easy storage and easily reassembled for use. Additionally, the adjustability allows a user to tune the path member 302/402 for that user's particular stature, skill level, stroke, etc. To that end, FIG. 10C shows a detail view of the second and third portions 302*b*/402*d* of the swing path training apparatus 402 (though it should be understood that this description is equally applicable to any part of the path member 302/402). FIG. 10D shows an individual example segment 500.

Each end of the segments 500 includes a corrugated track 502 or a corrugated tab 504 configured to be received in a corrugated track 502. The segments 500 are then arranged to form the path member 302/403 so that the end of one segment 500*a* includes a corrugated track 502 and the end of the adjacent segment 500*b* includes a corrugated tab 504. The corrugated tabs 504 include corresponding corrugations to the corrugated track 502. A position tab 506 extends from the corrugated tab 504 and is configured to be engage the corrugations of the corrugated track 502 such that the corrugated tabs 504 can be slid to a desired location along the corrugated track 502 and be retained in that location by the position tab 506 (best shown in FIG. 10C). In this way, by varying the location of the corrugated tab 504 in the corrugated track 500, the length of each portion 302*a*/302*b*/402*d* can be adjusted.

Referring again to FIG. 10C, in this example, the path member 342*b* includes a segment 500 having a curved portion 456 at the second transition point 402*e* while the path member 342*a* includes a segments 500 with an angled portion 458 at the transition point 402*e*. In another example, either or both of the path members 342*a*/342*b* could have a curved segment 500 or an angled segment at the second transition point 402*e*.

The size of the gap 344 can also be adjusted by adjusting the spacing between the guide members 342*a*/342*b*. In this example, shown in FIGS. 11A-B, the plate 318 includes a corrugated track 502 that is configured to receive a connector 504 which is connected to each of the guide members 342*a*/342*b*.

Figure 11A:
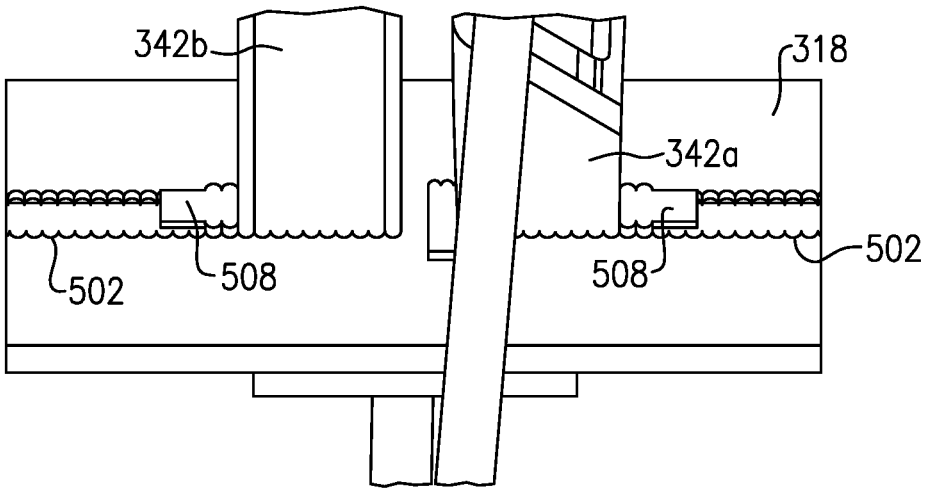
FIG. 11 shows a detail view of a connection between a support and a path member for the example swing path training apparatus of FIGS. 10A-B.
Figure 11B:
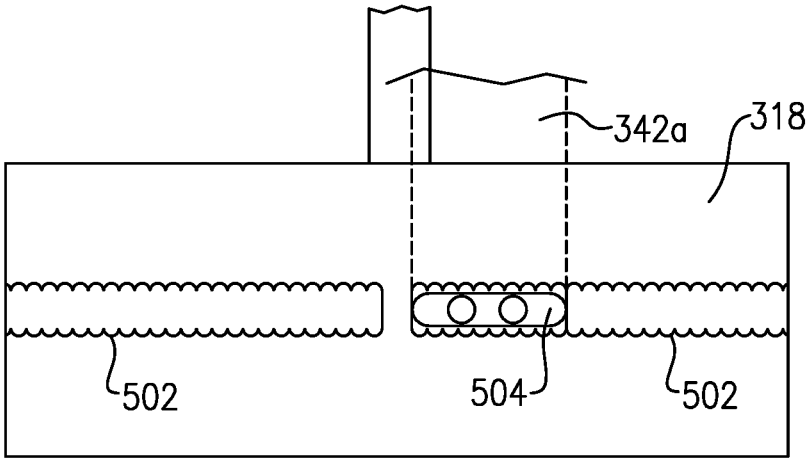
Figure 12:
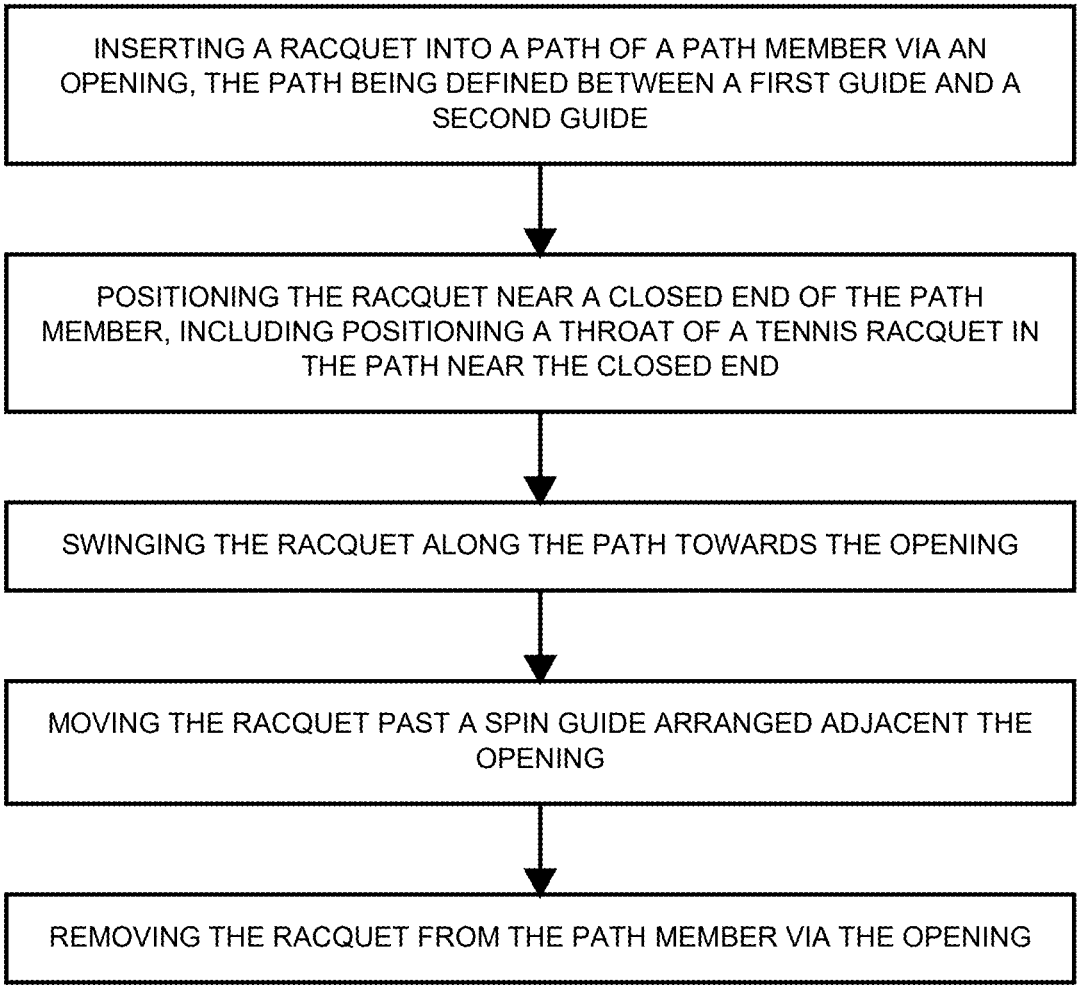
FIG. 12 illustrates a method of training a swing path.

In some further examples, a lock 508, shown in FIG. 11A, can provide additional retention for any of the above-described connectors 502 in any of the above-described tracks 504. The lock 508 engages the corrugations of the corrugated track and tab 502/504.

When a user uses the swing training apparatus 100/300 to practice a stroke, the user, racquet 200 in hand, stands beside the apparatus 100/300 and faces in the same direction that the path member 102/302 opens. The user's lead foot will generally be slightly forward of the closed end 148/348 of the path member 102/302. Additionally, the bottom of the path member 102/302 is adjusted to a height by any of the mechanisms/features discussed above that allows for the user's hips to be generally level with the open end or gap 144/344 of the path member 102/302. The throat 206 of the racquet 200 is inserted into the gap 144/344 such that the strings 202 in the head of the racquet 200 are generally perpendicular to the ground, but slightly angled with respect to the ground. The geometry of the path member 102/302 is selected to track a swing path for various swing techniques. The gap 144/344 is dimensioned so that the user can angle the racquet 200 through the entirety of the stroke to allow for various ball spin techniques such as top spin and back spin. For example, if the strings 202 are angled toward the ground as it strikes a ball, the swing would provide topspin to the ball. If the strings 202 are angled away from the ground when striking the ball, the swing would provide underspin (slice) to the ball. Other spins or no spin (flat) could also be achieved by varying the angle of the strings 202 in the head of the racquet 200 with respect to the ground.

In this way, the example swing path training apparatus 100/300 serves as an instructing device for racquet sports that guides a user's swing throughout the majority of the stroke. A physical guide such as the swing path training apparatus 100/300 ensures negligible deviation from the desired swing path. As a result, the training device encourages muscle memory for performing desired strokes such as the backhand or forehand stroke with specific swing paths so as to provide for different speeds, spins, and adjustments to the stroke. Exemplary adjustments may include the height of the ball when it is hit and the location of the ball (in front, behind, to the side of and relative distances) relative to the player.

Although certain dimensions and parameters are described herein, other dimensions and parameters are contemplated and can be utilized. Dimensions and parameters described as related to example lengths, sections, or portions of the swing path training apparatus 100/300 are not limited to these lengths, sections, or portions and may be utilized with other lengths, sections, or portions.

Although certain herein described examples have a specific combinations of features shown in the illustrations, this disclosure is not limited to those particular combinations. It is contemplated to use some of the features from one of the examples in combination with features from another one of the examples.

Furthermore, the foregoing description shall be interpreted as illustrative and not limiting in any sense. A worker of ordinary skill in the art would understand that certain modifications could come within the scope of this disclosure. For these reasons, the following claims should be studied to determine the true scope and content of this disclosure.

The invention claimed is:

1. A swing path training apparatus, comprising:
a support structure; and
a path member supported on the support structure, the path member including
a first guide and a second guide defining a path therebetween, wherein the path tracks the geometry of a swing path,
a closed end connecting the first guide and the second guide, and
an opening configured to allow a racquet to be inserted into or removed from the path,
wherein the support structure includes a support having a first end and a second end, wherein the first end is connected to the path member, and the second end having a clamp, wherein the clamp is configured to be connected to a post.

2. The swing path training apparatus of claim 1, wherein the path member is supported on the support structure via one or more retractable rods.

3. The swing path training apparatus of claim 1, wherein the path is a curved path.

4. The swing path training apparatus of claim 1, wherein the path is an angled path.

5. The swing path training apparatus of claim 4, wherein the path member comprises a plurality of segments removably connected to one another.

6. The swing path training apparatus of claim 5, wherein the plurality of segments are connected to one another via a corrugated track and a corrugated tab configured to be received in the corrugated track.

7. The swing path training apparatus of claim 4, wherein the angled path includes a first portion, a second portion perpendicular to the first portion, and a third portion perpendicular to the first and second portions.

8. The swing path training apparatus of claim 1, wherein the support structure includes a first support and a second support, and the first and second supports cross one another at a connection point.

9. The swing path training apparatus of claim 8, wherein the first support includes an opening configured at a connection to receive the second support.

10. The swing path training apparatus of claim 1, wherein the support is a first support and the clamp is a first clamp, and further comprising a second support, the second support having a second clamp configured to be connected to the post.

11. A swing path training apparatus, comprising:
a support structure;
a path member supported on the support structure, the path member including
a first guide and a second guide defining a path therebetween, wherein
the path tracks the geometry of a swing path,
a closed end connecting the first guide and the second guide, and
an opening configured to allow a racquet to be inserted into or removed from the path; and
a spin guide adjacent the opening, the spin guide having a wedge shape configured to affect an orientation of the racquet.

12. A method of training a swing path, comprising:
inserting a racquet into a path of a path member via an opening, the path being defined between a first guide and a second guide, wherein the path tracks the geometry of a swing path of the racquet;
positioning the racquet near a closed end of the path member; and
swinging the racquet along the path towards the opening, wherein the racquet is a tennis racquet, and further comprising positioning a throat of the tennis racquet in the path near the closed end of the path member.

13. The method of claim 12, further comprising removing the racquet from the path member via the opening.

14. The method of claim 12, wherein the path is a curved path.

15. The method of claim 12, wherein the path is an angled path.

16. The method of claim 12, further comprising moving the racquet past a spin guide arranged adjacent the opening after the swinging step, the spin guide having a wedge shape configured to affect an orientation of the racquet.

* * * * *